US007462132B2

(12) United States Patent
Kuehne

(10) Patent No.: US 7,462,132 B2
(45) Date of Patent: Dec. 9, 2008

(54) EXERCISE DEVICE FOR FACIAL MUSCLES

(76) Inventor: Jonas Johannes Kuehne, 2525 La Mesa Dr., Santa Monica, CA (US) 90402

( * ) Notice: Subject to any disclaimer, the term of this patent is extended or adjusted under 35 U.S.C. 154(b) by 539 days.

(21) Appl. No.: 11/169,198

(22) Filed: Jun. 28, 2005

(65) Prior Publication Data

US 2006/0293152 A1 Dec. 28, 2006

(51) Int. Cl.
*A63B 23/03* (2006.01)
*A61C 5/14* (2006.01)

(52) U.S. Cl. ..... 482/11; 128/861

(58) Field of Classification Search ..... 482/10–11, 482/148; 128/859–863; 433/6, 68–69, 73, 433/140; 601/38

See application file for complete search history.

(56) References Cited

U.S. PATENT DOCUMENTS 1,855,573 A * 4/1932 Haber ..... 73/379.03
2,418,648 A * 4/1947 Kile ..... 433/69
3,525,520 A 8/1970 Dwyer
4,185,817 A 1/1980 Peterson
5,031,611 A * 7/1991 Moles ..... 128/201.11
5,577,983 A * 11/1996 Fraser ..... 482/11
5,794,627 A * 8/1998 Frantz et al. ..... 128/848
6,012,919 A * 1/2000 Cross et al. ..... 433/6
6,152,730 A * 11/2000 Wildman ..... 433/68
6,524,225 B1 2/2003 Arias
7,134,986 B2 * 11/2006 Tiberio ..... 482/11
2006/0293152 A1 * 12/2006 Kuehne ..... 482/11

FOREIGN PATENT DOCUMENTS

WO WO 93/20900 10/1993

* cited by examiner

*Primary Examiner*—Fenn C Mathew

(57) ABSTRACT

An apparatus for exercising facial muscles. A first embodiment includes two arms, each having an end portion with a hole wherein is disposed a bifurcated pad assembly having an upper and a lower pad. Each pad is adapted to receive teeth and has a surface attached to a neck with a circumferential groove allowing the neck to be held within the rims of the end portion holes. A second embodiment includes two interconnected Y-shaped assemblies, each having two arms with an end portion holes wherein is disposed a bifurcated pad assembly each having an upper and a lower pad. Each pad is adapted to receive teeth and has a surface attached to a neck with a circumferential groove allowing the neck to be held within the rims of the end portion holes. In both embodiments, the separation between laterally opposed pad assemblies is incrementally adjustable.

13 Claims, 9 Drawing Sheets

FIG.1
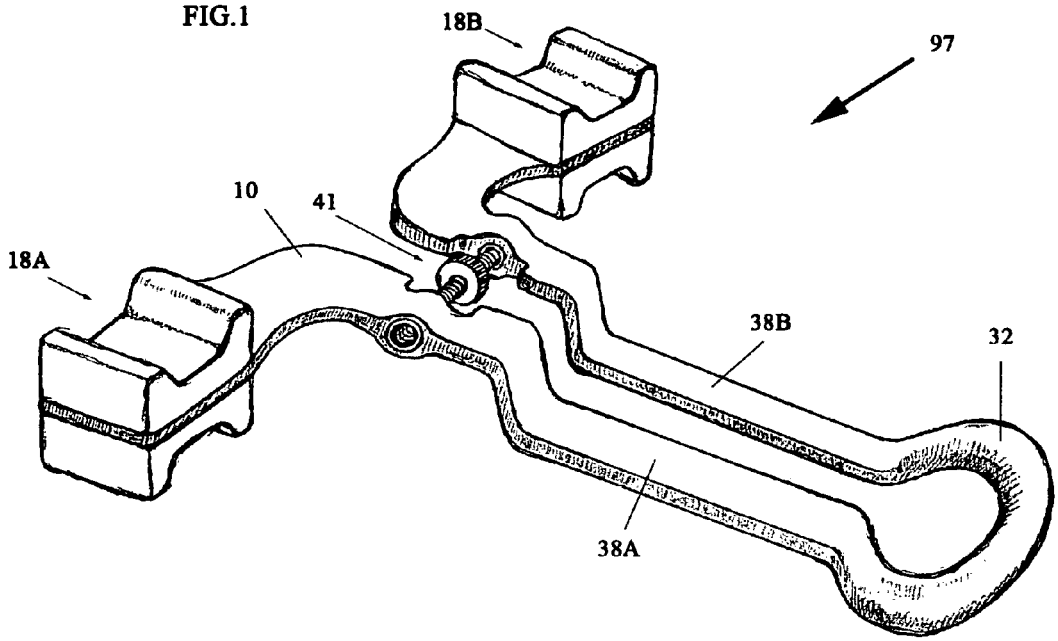
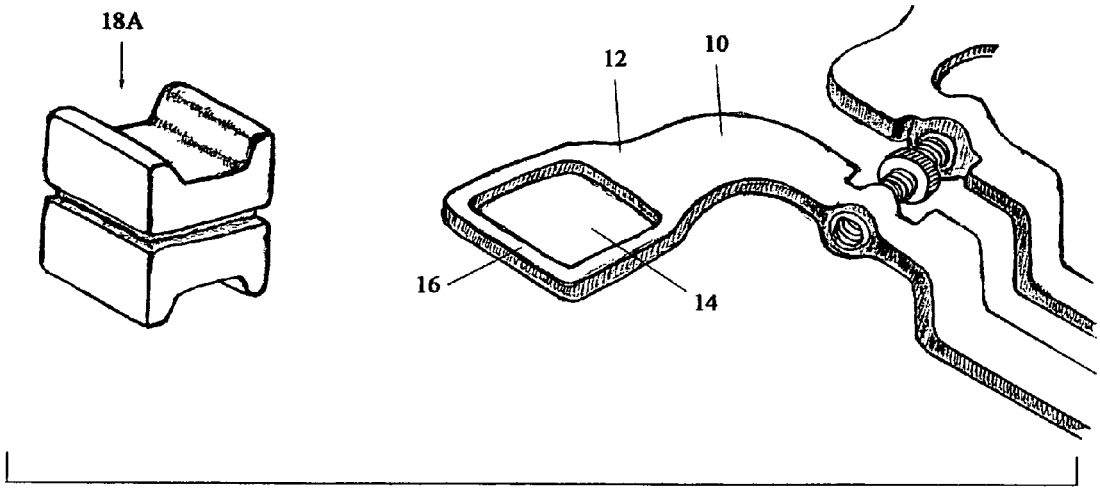
FIG.2

EXERCISE DEVICE FOR FACIAL MUSCLES

BACKGROUND OF THE INVENTION

1. Field

This invention relates to muscle exercise, specifically to exercise of the facial muscles.

2. Related Art

Exercise produces a profound effect upon the size and strength of skeletal muscle. It is known that exercise induces synthesis of muscle contractile proteins causing hypertrophy, which is an increase in size of muscle. As muscles grow larger they become more closely apposed to the external surface, creating tightness in the overlying skin and tissues. This can generate pleasing esthetic effects, producing firm arms and abdominal walls for example and combating the age-associated process of muscle atrophy. It is also known that exercise increases the metabolic demands of the exercising muscle and leads to an increased blood supply to the muscle(s) being trained. As metabolic demands increase, subcutaneous fat stores are utilized and reduced in size. Standard exercise regimes often ignore the muscles of the face, and the only exercise the facial muscles receive is through activities of daily living such as chewing food or making facial expressions. These activities alone are sufficient to maintain facial muscle strength at a baseline level, but more focused exercise using resistance training is required to generate the significant increases in facial muscle size requisite for an observable esthetic benefit.

Previous inventors have taken a variety of approaches to the problem of providing an efficient means of exercising the facial muscles. One of the primary deficiencies of devices in the related art is that they fail to take into account the great lateral mobility of the jaw. In the action of chewing food, the jaw does not simply open and close in an up-and-down motion but also moves laterally side-to-side. Many people have jaws that are imperfectly aligned and are forced to move either their upper or lower jaw laterally in order to completely close the jaw. A second deficiency of these devices is failure to provide adequate proportions of isotonic contraction of the facial muscles. In exercising a muscle with the goal of building muscle size, it is important not only that the muscle contract against a resistance, but also that it be allowed to shorten during its contractile cycle. A muscle contraction in which the muscle contracts and increases tension but does not change in length is called an isometric contraction. A muscle contraction in which a muscle contracts and changes in length but does not change in tension is called an isotonic contraction. Isotonic contractions are preferred over isometric contractions in muscle building for a variety of reasons, such as limited blood flow to a muscle during an isometric contraction.

Objects and Advantages

Accordingly, several objects and advantages of the present invention are:

a) to provide a simple, non-electric apparatus for exercising the facial muscles that employs resistance training to maximize muscle growth;

b) to provide an apparatus for exercising the facial muscles that is adjustable to fit into the full spectrum of jaw sizes;

c) to provide an apparatus for exercising the facial muscles that allows enough jaw movement to efficiently utilize an isotonic contraction component of the exercise;

d) to provide an apparatus that maintains lateral stability during use; and e) to provide an apparatus that provides consistent resistance training of the facial muscles to a wide variety of operators;

Further objects and advantages will become apparent from a consideration of the detailed description and figures.

SUMMARY

In a first aspect the invention provides an apparatus for exercising facial muscles, including an even plurality of arms each having an end portion and a hole determined by a circumferential rim. The apparatus further includes an equal plurality of bifurcated pad assemblies each having an upper and a lower pad made of compressible, resilient material. Each upper pad has an upper surface with an indentation adapted to closely receive a portion of at least one upper tooth and a lower surface attached to a neck with a circumferential groove. Each lower pad has a lower surface with an indentation adapted to closely receive a portion of at least one lower tooth, and an upper surface attached to the neck. The lower pad of each assembly is inserted through an end portion hole and the hole rim is received within the neck groove. At least one pair of pad assemblies are laterally opposed. The apparatus further includes means for incrementally adjusting the distance separating each pair of laterally opposed pad assemblies.

In a second aspect the invention provides an apparatus for exercising facial muscles that includes first and second arms having, respectively, opposed first and second generally parallel central portions, first and second end distal portions attached to a handle, and opposed first and second proximal end portions each having a hole determined by a circumferential rim and two bifurcated pad assemblies each having an upper and lower pads made of compressible, resilient material. Each upper pad has an upper surface with an indentation adapted to closely receive a portion of at least one upper molar tooth, and a lower surface attached to a neck with a circumferential groove. Each lower pad has a lower surface with an indentation adapted to closely receive a portion of at least one lower molar tooth, and an upper surface attached to the neck. The lower pad of each assembly is inserted through an end portion hole so the hole rim is received within the neck groove. The first and second arm central portions each include a proximal subportion having an interior edge with a tapped hole. Each hole is engaged by a threaded end of a shaft having a knob symmetrically disposed between the two edges whereby the shaft end depth within each hole can be incrementally adjusted.

In a third aspect the invention provides an apparatus for exercising facial muscles, including two interconnected Y-shaped assemblies and four bifurcated pad assemblies. The first Y-shaped assembly is formed by two arms, each of which attaches distally to a tongue and has an opposed proximal end portion with a hole determined by a circumferential rim. The second Y-shaped assembly is formed by two arms having opposed proximal end portions with a hole determined by a circumferential rim, each arm attached distally to a sleeve having an upper surface and a longitudinal slot. The two Y-shaped assemblies interconnect when the tongue of the first Y-shaped assembly is received closely within the slot of the second Y-shaped assembly. The four bifurcated assemblies each have upper and lower pad made of compressible, resilient material. The upper pads of the first and third pad assemblies have an upper surface with an indentation adapted to closely receive a portion of at least one upper molar tooth, and the upper pads of the second and fourth pad assemblies have an upper surface with an indentation adapted to closely receive a portion of at least one upper premolar tooth. The upper pads of all four bifurcated pad assemblies have a lower surface attached to a neck with a circumferential groove. The lower pads of the first and third pad assemblies have a lower surface with an indentation adapted to closely receive a portion of at least one lower molar tooth, and the lower pads of the second and fourth pad assemblies have a lower surface with an indentation adapted to closely receive a portion of at least one lower premolar tooth. The lower pads of all four assemblies has an upper surface attached to the neck. The lower pad of each pad assembly is inserted through an end portion hole so the hole rim is received within the neck groove, with the first and third pad assemblies laterally opposed and the second and fourth pad assemblies laterally opposed.

SUMMARY-DESCRIPTION OF DRAWINGS

FIG. 1 is a perspective view of an exercise apparatus according to a first embodiment of the invention, including a handle, parallel arms with end pieces with holes containing bifurcated pad assemblies.

FIG. 2 shows a FIG. 1 pad assembly removed from an arm hole.

DETAILED DESCRIPTION OF THE PREFERRED EMBODIMENTS

Figure 3A:
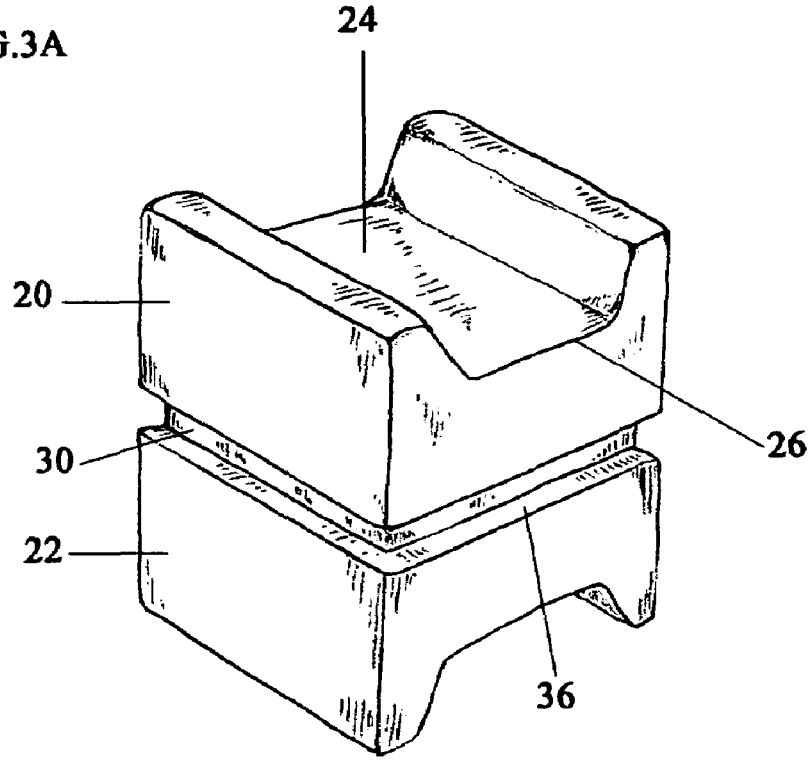
FIGS. 3A and 3B show two perspective views of the FIGS. 1 and 2 pad assembly.
Figure 3B:
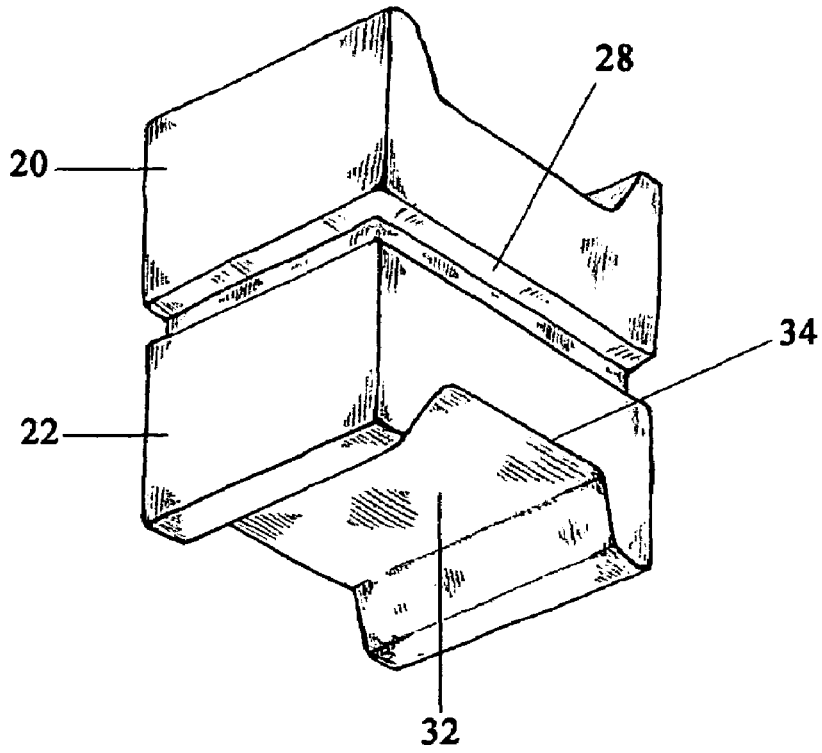
Figure 4:
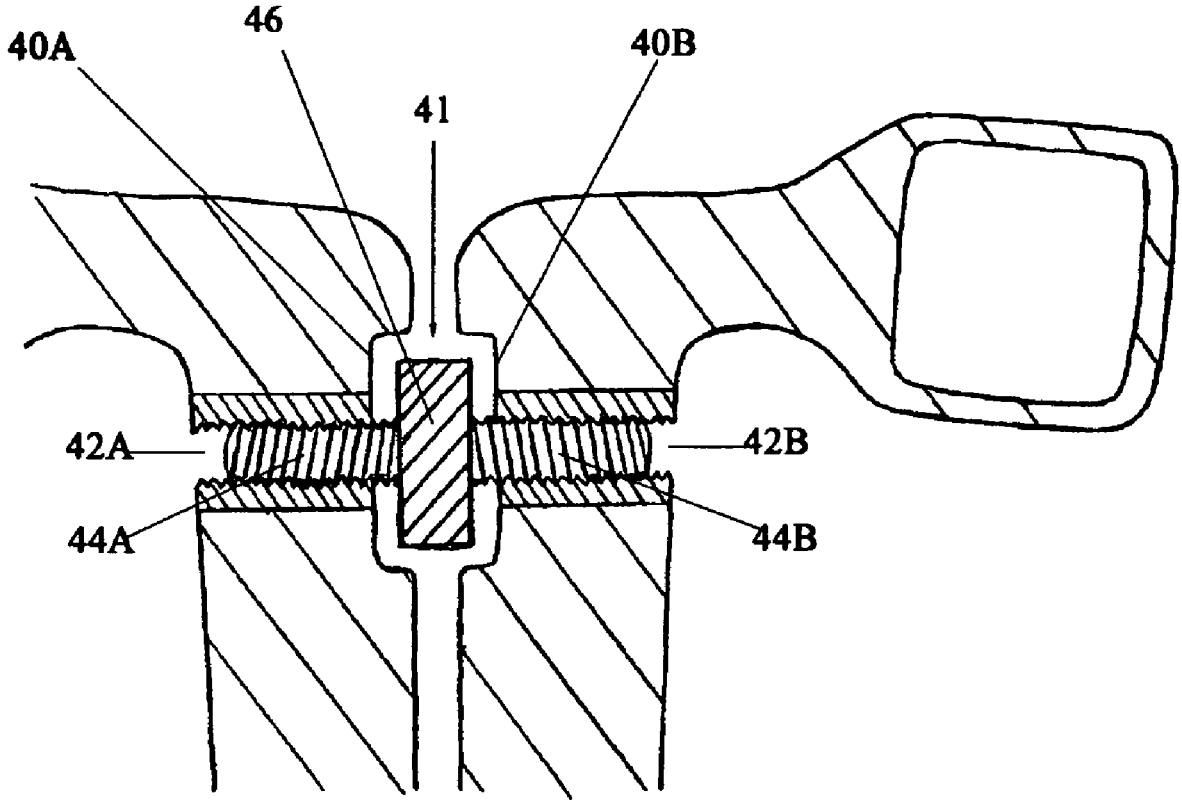
FIG. 4 is a detail view of an adjustable spacer connecting the two arms.

Referring to FIGS. 1 and 2, an exercise apparatus for the facial muscles according to a first embodiment 97 includes first and second parallel arms 38A, 38B attached distally to an arcuate handle 32. Each arm has an end portion 12 of a pre-selected thickness, and each of the arms 38A, 38B has laterally opposed holes 14 therethrough determined by a circumferential rim 16 into which bifurcated pad assemblies 18A, 18B, respectively, are inserted. Referring to FIGS. 3A and 3B the bifurcated pad assemblies 18A, 18B each have upper and lower pads made of a compressible, resilient material. Each upper pad 20 has an upper surface 26 with a first indentation 24 adapted to closely and comfortably receive a portion of at least one upper tooth, and a lower surface 28 attached to a neck with a circumferential groove 30 and a length slightly larger than the end-portion thickness. Each lower pad 22 has a lower surface 34 with a second indentation 32 adapted to closely and comfortably receive a portion of at least one lower tooth, and an upper surface 36 attached to the neck 30. In assembling the apparatus, the lower pad 22 of each bifurcated pad assembly 18A, 18B is inserted through an end-portion hole 14 with the hole rim 16 received within the groove of the neck 30. As shown in FIGS. 1 and 2, the distance separating the pad assemblies is adjustable by means of a spacer 41 of incrementally adjustable length. Referring to FIG. 4, interior edges 40A, 40B of each arm 38A, 38B has tapped holes 42A, 42B engaged by a threaded end of shaft 44A, 44B. Knob 46 is symmetrically disposed between interior edges 40A, 40B whereby the shaft 44 end depth within each hole 42 can be adjusted. Spacer 41 allows the user to adjust the separation between the pad assemblies 18A, 18B to match a user's mandibular arch. The length of the arms as measured from the arcuate handle 32 to the pad assemblies 18A, 18B should be sufficiently long such that when the apparatus is positioned within the user's mouth, the pad assemblies 18A, 18B rest comfortably between the upper and lower molar teeth, and a sufficient length of the arcuate handle 32 protrudes from the mouth to be gripped.

Figure 5:
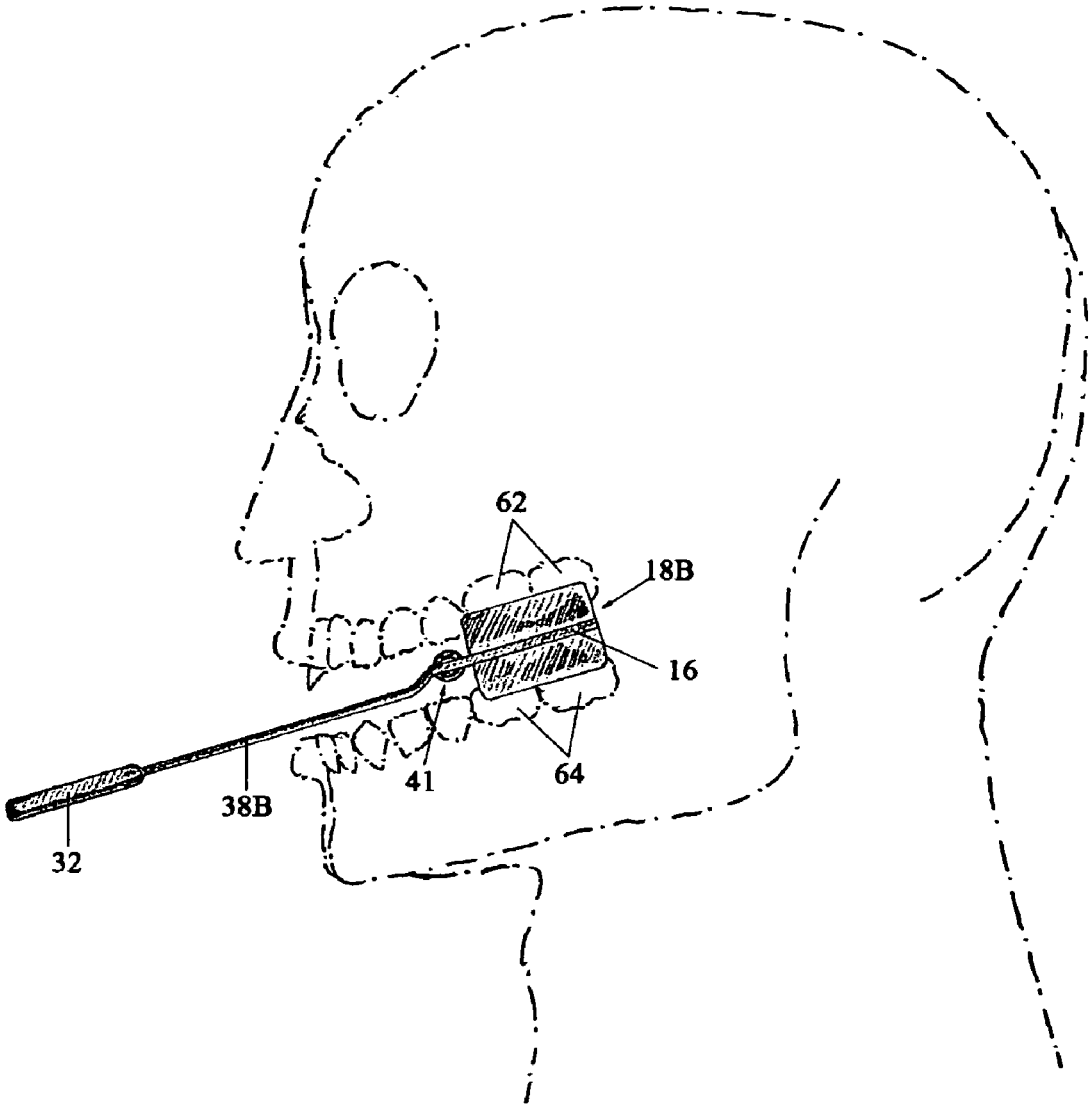
FIG. 5 illustrates use of the FIG. 1 apparatus.
Figure 6:
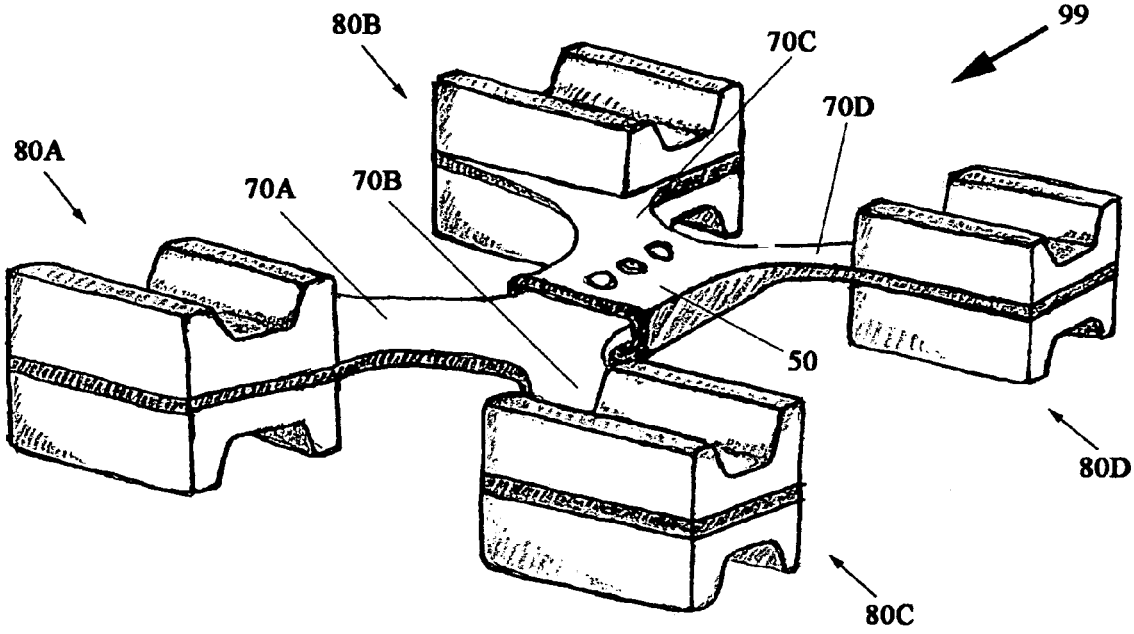
FIG. 6 is a perspective view of an exercise apparatus according to a second embodiment of the invention including two interconnecting Y-shaped assemblies, each having two arms with end portion holes and four bifurcated pad assemblies each having upper and lower pads.
Figure 7:
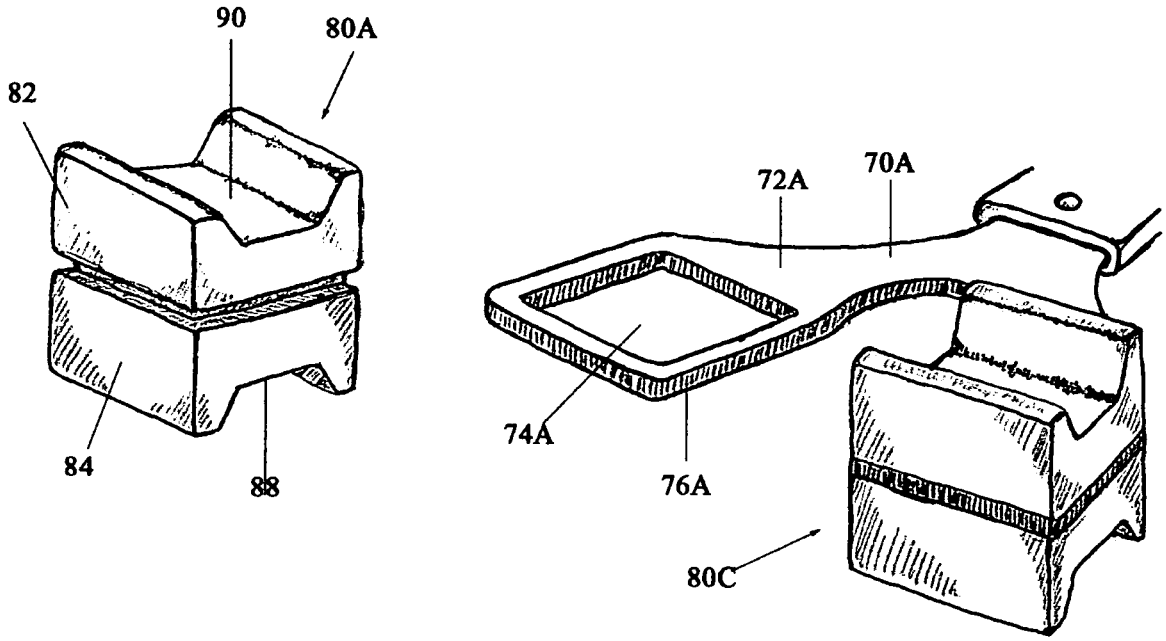
FIG. 7 shows a FIG. 6 pad assembly removed from an arm hole.
Figure 8:
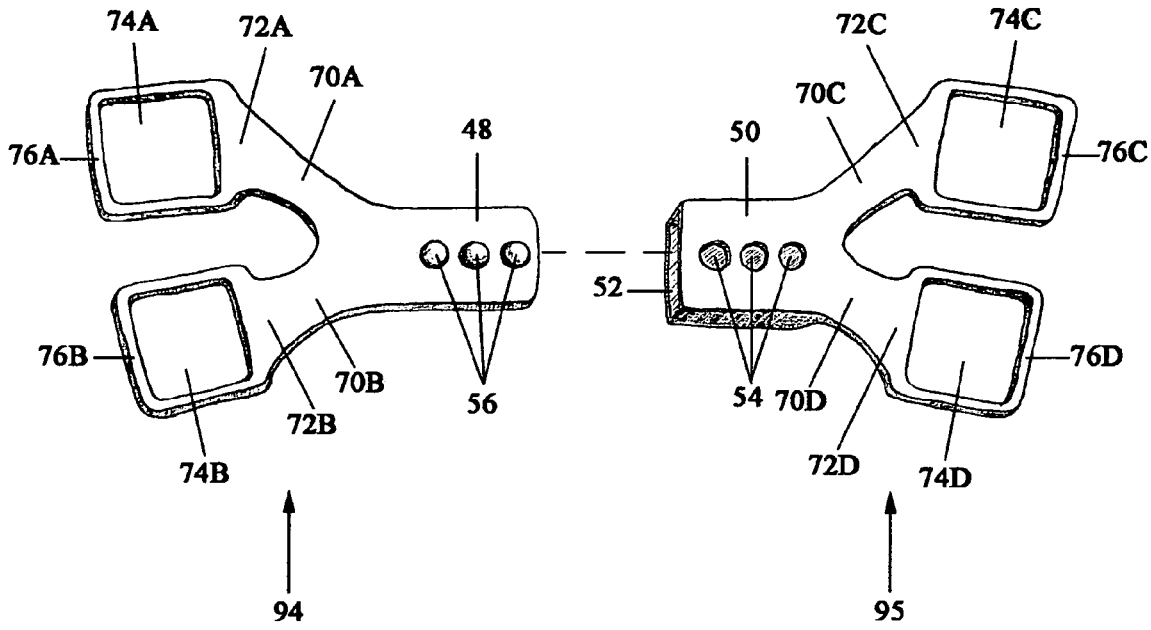
FIG. 8 shows the first and second Y-shaped assemblies of the FIG. 6 apparatus.
Figure 9A:
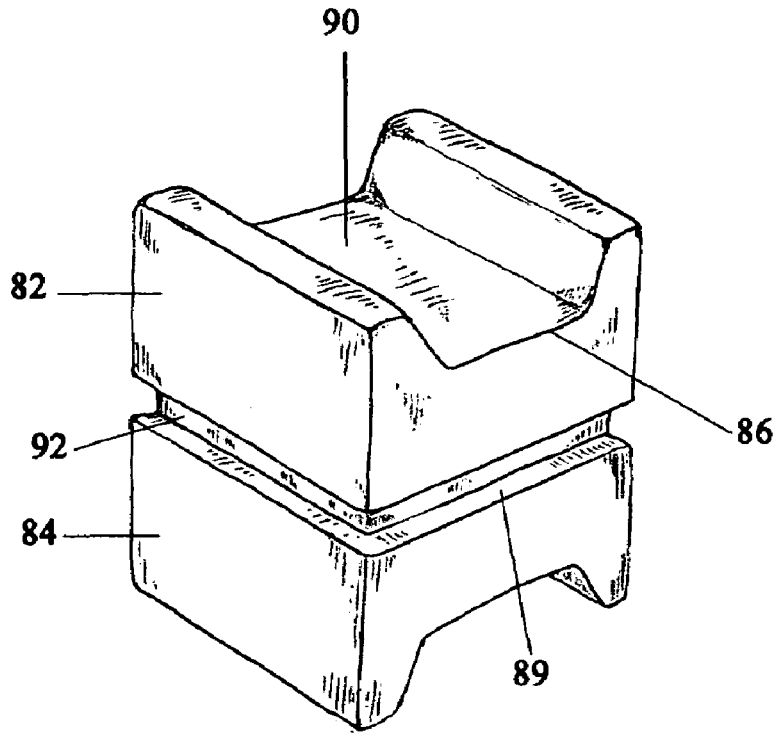
FIGS. 9A and 9B show two perspective views of the FIGS. 6 and 7 pad assembly.
Figure 9B:
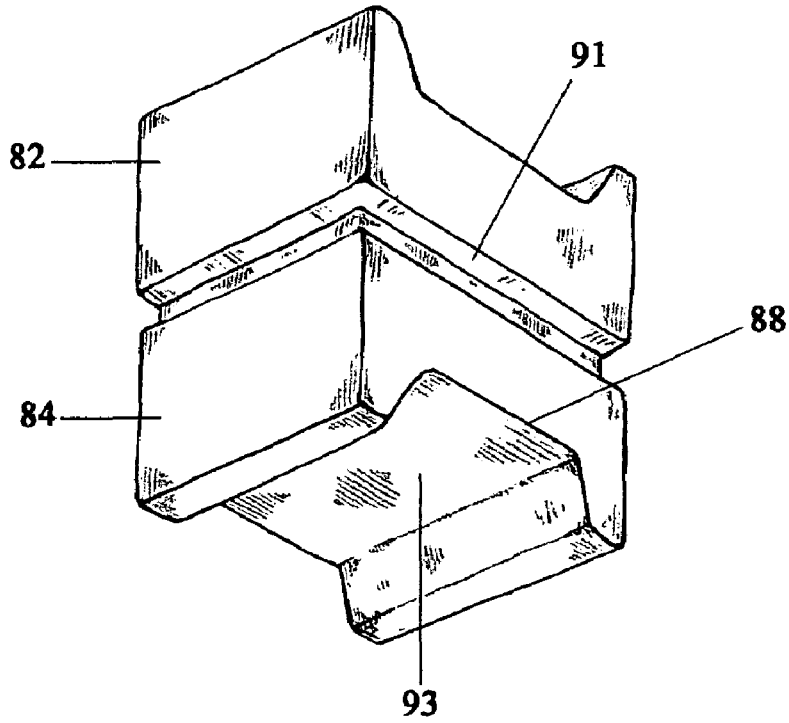

FIG. 5 illustrates use of apparatus 97. First, the user utilizes spacer 41 to adjust the separation between the pad assemblies 18A, 18B to match his or her mandibular arch. The user, holding the apparatus by handle 32, inserts the arms 38A, 38B with pad assemblies 18A, 18B into his or her mouth, and positions the pad assemblies comfortably between the upper and lower molar teeth 62, 64, respectively, such that the upper surfaces 26 of upper pads 20 comfortably receive the upper molar teeth into the indentations 24, and the lower surfaces 34 of lower pads 22 comfortably receive the lower molar teeth into the indentations 32. The teeth should be comfortably and firmly positioned within the upper indentations 24 and lower indentations 32 so that lateral motion during the exercise will be minimized. The user exercises the facial muscles by repeatedly biting down against the resistance provided by the pad assemblies 18A, 18B.

Referring to FIGS. 6, 7, 8 and 9 a second embodiment of an exercise apparatus 99 according to the invention includes first and second arms 70A, 70B attached to a central tongue 48 forming a first Y-shaped assembly 94. A second Y-shaped assembly 95 includes two arms 70C, 70D attached to a central sleeve 50 having a longitudinal slot 52 that receives a central tongue 48 of first assembly 94. Each arm 70A, 70B, 70C, 70D in first assembly 94 and second assembly 95 has an end portion 72A, 72B, 72C, 72D and each of the arms 70A, 70B, 70C, 70D has holes therethrough 74A, 74B, 74C, 74D determined by a circumferential rim 76A, 76B, 76C, 76D into which one of four bifurcated pad assemblies 80A, 80B, 80C, 80D is inserted. The bifurcated pad assemblies 80A, 80B, 80C, 80D each have upper and lower pads 82, 84, respectively, made of a compressible, resilient material. Each upper pad 82 has an upper surface 86 with an indentation 90 adapted to closely and comfortably receive a portion of at least one upper tooth, and a lower surface 91 attached to a neck with a circumferential groove 92. Each lower pad 84 has a lower surface 88 with a second indentation 93 adapted to closely and comfortably receive a portion of at least one lower tooth, and an upper surface 89 attached to the neck 92. In assembling the apparatus, the lower pad 84 of each bifurcated pad assembly 80A, 80B, 80C, 80D is inserted through an end-portion hole 74A, 74B, 74C, 74D, respectively, with the hole rim 76A, 76B, 76C, 76D received within the groove of the neck 92. When the first assembly 94 is connected to the second assembly 95 by insertion of tongue 48 into sleeve 52, the four pad assemblies 80A, 80B, 80C, 80D are grouped into two pairs of laterally opposed pad assemblies, with each pair of laterally opposed pad assemblies comprised of one pad assembly from the first assembly 94 and one pad assembly from the second assembly 95. The distance between laterally opposed pad assemblies is adjustable by modifying the depth of insertion of tongue 48 of first assembly 94 into sleeve 52 of second assembly 95. The upper surface 50 of sleeve 52 contains several equidistant and collinear holes 54, the distances between these holes 54 equal to the distances between several equidistant collinear prongs 56 located on the upper surface of the tongue. The depth of insertion of tongue 48 into sleeve 52 is stabilized by insertion of prongs 56 on the upper surface of tongue 48 into the holes 54 on upper surface 50 of sleeve 52.

Figure 10:
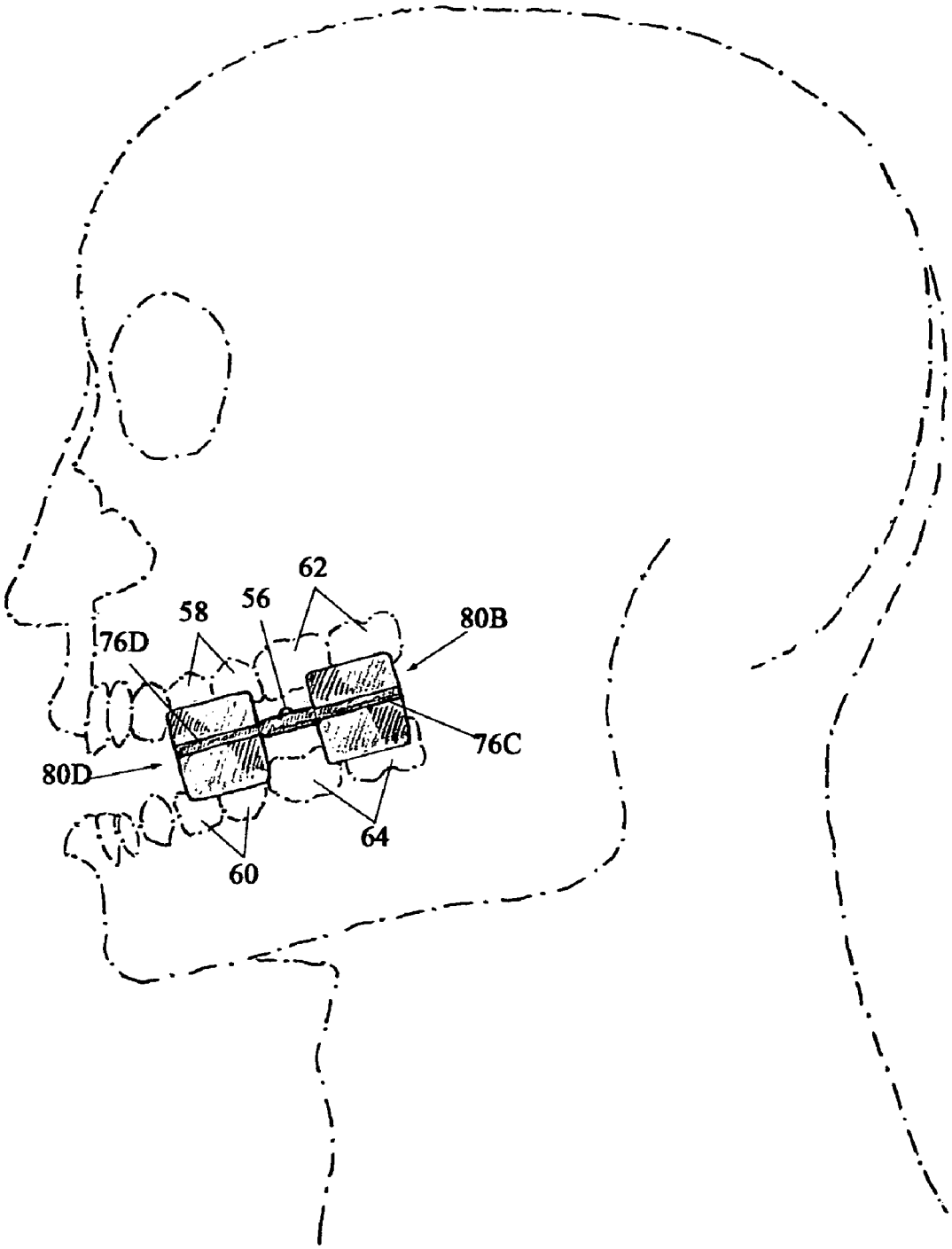
FIG. 10 illustrates use of the FIG. 6 apparatus.

Referring to FIG. 10, a user of apparatus 99 adjusts the distance between the laterally opposed pad assemblies 80A, 80B, 80C, 80D to match his or her mandibular arch by adjusting the depth of insertion of tongue 48 of first assembly 94 into sleeve 50 of second assembly 95. The user then inserts the apparatus into the mouth and positions the apparatus such that one pair of laterally opposed pad assemblies is positioned comfortably between his or her upper and lower molar teeth, 62, 64, respectively, with the upper surfaces 86 of the upper pads 82 comfortably receiving the upper molar teeth into indentations 90 and lower surfaces 88 of lower pads 84 comfortably receiving the lower molar teeth in indentations 93, while the second pair of laterally opposed pad assemblies is positioned comfortably between his or her pre-molar teeth, such that such that the upper surfaces 86 of the upper pads 82 comfortably receive the upper pre-molar teeth 58 into indentations 90 and the lower surfaces 88 of the lower pads 84 comfortably receive the lower pre-molar teeth 60 in indentations 93. The teeth should be comfortably and firmly positioned within the upper indentations 90 and lower indentations 93 of the pad assemblies 80A, 80B, 80C, 80D so that lateral motion during exercise will be minimized. Then, the user exercises the facial muscles by repeatedly biting down against the resistance provided by the pad assemblies 80A, 80B, 80C, 80D.

The descriptions provided herein should not be construed as limiting the scope of the invention but as providing examples of two embodiments of this invention. For example, the pad assemblies can have other shapes such as circular, oval, or triangular; and other mechanisms for adjusting the distance between the pad assemblies may be used. Thus the scope of the invention should be determined by the appended claims and their legal equivalents, rather than by the examples given.

What is claimed is:

1. An apparatus for exercising facial muscles, comprising:

a) an even plurality of arms each having an end portion of a pre-selected thickness and a hole there-through determined by a circumferential rim;

b) an equal plurality of bifurcated pad assemblies each having an upper and a lower pad made of compressible, resilient material, each upper pad having an upper surface with a first indentation adapted to closely receive a portion of at least one upper tooth, and a lower surface attached to a neck with a circumferential groove and a thickness slightly larger than the end portion thickness, each lower pad having a lower surface with a second indentation adapted to closely receive a portion of at least one lower tooth, and an upper surface attached to the neck, the lower pad of each pad assembly inserted through an end portion hole and the hole rim received within the groove;

c) at least one pair of laterally opposed pad assemblies; and d) means for incrementally adjusting the distance separating each pair of laterally opposed pad assemblies.

2. The apparatus of claim 1, wherein:

a) said plurality is 2;

b) the two arms are attached distally to an arcuate handle;

c) each first indentation receives a portion of at least one upper molar tooth;

d) each second indentation receives a portion of at least one lower molar tooth; and e) said means for incrementally adjusting the distance separating the pad assemblies comprises a spacer of incrementally adjustable length connected between the arms.

3. The apparatus of claim 1, wherein said plurality is 4;

a) first and second arms are attached to a tongue, forming a first Y-shaped assembly;

b) third and fourth arms are attached to a sleeve having a longitudinal slot, forming a second Y-shaped assembly, the tongue closely received within the slot;

c) a first pair of pad assemblies, one on the first Y-shaped assembly and the other on the second Y-shaped assembly, are laterally opposed and each first indentation thereof receives a portion of at least one upper molar tooth, and each second indentation thereof receives a portion of at least one lower molar tooth;

d) a second pair of pad assemblies, one on the first Y-shaped assembly and the other on the second Y-shaped assembly, are laterally opposed and each first indentation thereof receives a portion of at least one upper premolar tooth, and each second indentation thereof receives a portion of at least one lower premolar tooth; and e) said means for incrementally adjusting the distance separating the first pair of pad assemblies and the second pair of pad assemblies comprises slidably positioning and fixing the tongue within the slot.

4. An apparatus for exercising facial muscles, comprising:

a) first and second arms having, respectively, oppposed first and second central portions, first and second end distal portions attached to an arcuate handle, and opposed first and second proximal end portions each having upper and lower surfaces determining a common pre-selected thickness and a hole there-through determined by a circumferential rim; and b) first and second bifurcated pad assemblies each having upper and lower pads made of compressible, resilient material, each upper pad having an upper surface with a first indentation adapted to closely receive a portion of at least one upper molar tooth, and a lower surface attached to a neck with a circumferential groove and having a thickness slightly larger than the end portion thickness, each lower pad having a lower surface with a second indentation adapted to closely receive a portion of at least one lower molar tooth, and an upper surface attached to the neck, the lower pad of each assembly inserted through an end portion hole so the hole rim is received within the groove; and c) the first and second arm central portions each comprising a proximal sub-portion having an interior edge with a tapped hole, each hole engaged by a threaded end of a shaft having a knob symmetrically disposed between the two edges whereby the shaft end depth within each hole can be adjusted.

5. The apparatus of claim 4, wherein the arms consist essentially of polypropylene.

6. The apparatus of claim 4, wherein the pads consist of material demonstrated to be non-toxic and safe for use in a human mouth.

7. The apparatus of claim 6, wherein the pads consist essentially of a silicone rubber.

8. An apparatus for exercising facial muscles, comprising:

a) first and second arms having, respectively, opposed first and second proximal end portions each having upper and lower surfaces determining a common pre-selected thickness and a hole there-through determined by a circumferential rim, each arm attached distally to a tongue, the arms and tongue forming a first y-shaped assembly;

b) third and fourth arms having, respectively, opposed third and fourth proximal end portions each having an upper and lower surfaces of said common thickness and a hole there-through determined by a circumferential rim, each arm attached distally to a sleeve having an upper surface and a longitudinal slot, the arms and sleeve forming a second Y-shaped assembly, said tongue closely received within the slot;

c) first, second, third, and fourth bifurcated pad assemblies each having an upper and lower pads made of compressible, resilient material, the upper pad of the first and third pad assemblies having an upper surface with a first indentation adapted to closely receive a portion of at least one upper molar tooth, the upper pad of the second and fourth pad assemblies having an upper surface with a first indentation adapted to closely receive a portion of at least one upper premolar tooth, the upper pad of the first, second, third, and fourth pad assemblies having a lower surface attached to a neck with a circumferential groove and a thickness slightly larger than the end portion thickness, the lower pad of the first and third pad assemblies having a lower surface with a second indentation adapted to closely receive a portion of at least one lower molar tooth, the lower pad of the second and fourth pad assemblies having a lower surface with a second indentation adapted to closely receive a portion of at least one lower premolar tooth, the lower pad of the first, second, third and fourth assemblies having an upper surface attached to the neck, the lower pad of each pad assembly inserted through an end portion hole so the hole rim is received within the groove;

d) the first and third pad assemblies laterally opposed; and e) the second and fourth pad assemblies laterally opposed.

9. The apparatus of claim 8, further comprising means for changing the separation between the first and third pad assemblies, and between the second and fourth pad assemblies.

10. The apparatus of claim 9, wherein said means comprises a first plurality of holes in the sleeve upper surface, a second plurality of prongs in the tongue, said holes collinear and equally spaced and said prongs collinear and equally spaced.

11. The apparatus of claim 10, wherein the arms consist essentially of polypropylene.

12. The apparatus of claim 10, wherein the arms consist of material demonstrated to be non-toxic and safe for use in a human mouth.

13. The apparatus of claim 12, wherein the pads consist essentially of a silicone rubber.

* * * * *